US011286441B2

(12) United States Patent
DeBlase et al.

(10) Patent No.: US 11,286,441 B2
(45) Date of Patent: Mar. 29, 2022

(54) ANTI-WEAR COMPOSITION FOR LUBRICANTS

(71) Applicant: LANXESS Solutions US Inc., Shelton, CT (US)

(72) Inventors: Frank J. DeBlase, Hopewell Junction, NY (US); Joseph Stieber, Prospect, CT (US); Kenneth Cory MacLeod, Prospect, CT (US)

(73) Assignee: LANXESS Corporation, Pittsburgh, PA (US)

( * ) Notice: Subject to any disclaimer, the term of this patent is extended or adjusted under 35 U.S.C. 154(b) by 0 days.

(21) Appl. No.: 16/969,136

(22) PCT Filed: Feb. 8, 2019

(86) PCT No.: PCT/US2019/017307
§ 371 (c)(1),
(2) Date: Aug. 11, 2020

(87) PCT Pub. No.: WO2019/157350
PCT Pub. Date: Aug. 15, 2019

(65) Prior Publication Data

US 2021/0040411 A1 Feb. 11, 2021

Related U.S. Application Data

(60) Provisional application No. 62/629,171, filed on Feb. 12, 2018.

(51) Int. Cl.
*C10M 129/72* (2006.01)
*C10M 133/16* (2006.01)
(Continued)

(52) U.S. Cl.
CPC ..... *C10M 129/72* (2013.01); *C10M 133/16* (2013.01); *C10M 137/10* (2013.01);
(Continued)

(58) Field of Classification Search
CPC ..... C10M 129/72; C10M 133/16; C10M 137/10; C10M 169/04; C10M 2207/282;
(Continued)

(56) References Cited

U.S. PATENT DOCUMENTS 4,868,236 A 9/1989 O'Lenick, Jr.
5,338,470 A * 8/1994 Hiebert ..... C10M 129/36 508/454
5,498,809 A 3/1996 Emert et al.
7,696,136 B2 4/2010 Migdal et al.
(Continued)

FOREIGN PATENT DOCUMENTS

EP 3187254 A1 7/2017
GB 1450273 A 9/1976

OTHER PUBLICATIONS

International Search Report and Written Opinion, from International Application No. PCT/US19/17307, dated Apr. 23, 2019, ten pages.
(Continued)

*Primary Examiner* — Ellen M McAvoy
(74) *Attorney, Agent, or Firm* — Nicanor A. Kohncke; Christopher L. McDavid; Ewa M. Wozniak

(57) ABSTRACT

Certain citric esters and amides, and certain mixtures thereof, e.g., mixtures comprising citrate oligomers, exhibit excellent anti-wear activity in lubricants. Many of these compounds or mixtures of compounds also exhibit a high degree of anti-wear synergy in combination with zinc dihydrocarbyldithiophosphates. The compounds of the invention are thus valuable tools that can allow one to reduce the amounts of zinc, and phosphates, that are used in the lubricant without sacrificing anti-wear performance.

27 Claims, 1 Drawing Sheet

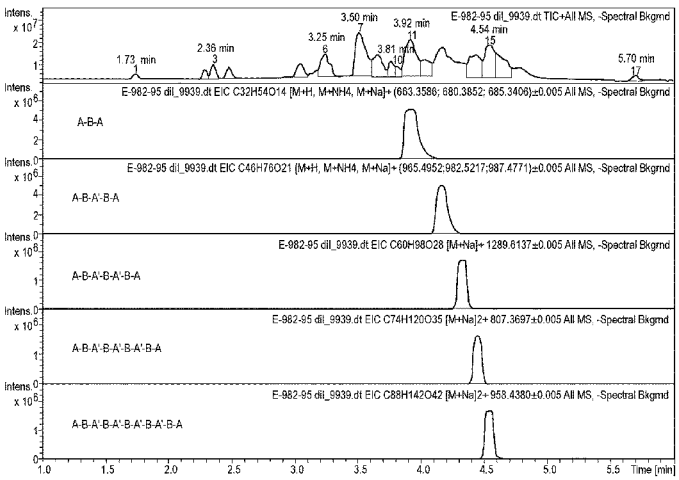

(51) Int. Cl.

| | |
|---|---|
| ***C10M 137/10*** | (2006.01) |
| ***C10M 169/04*** | (2006.01) |
| *C10N 10/04* | (2006.01) |
| *C10N 30/06* | (2006.01) |
| *C10N 30/10* | (2006.01) |
| *C10N 40/25* | (2006.01) |

(52) U.S. Cl.
CPC .... *C10M 169/04* (2013.01); *C10M 2207/282* (2013.01); *C10M 2215/082* (2013.01); *C10M 2223/045* (2013.01); *C10N 2010/04* (2013.01); *C10N 2030/06* (2013.01); *C10N 2030/10* (2013.01); *C10N 2040/25* (2013.01)

(58) Field of Classification Search
CPC ..... C10M 2215/082; C10M 2223/045; C10N 2010/04; C10N 2030/06; C10N 2030/10; C10N 2040/25
See application file for complete search history.

(56) References Cited

U.S. PATENT DOCUMENTS

| | | | | |
|---|---|---|---|---|
| 9,080,120 | B2 | 7/2015 | Adams et al. | |
| 2005/0198894 | A1* | 9/2005 | Migdal | C10M 129/76 44/388 |
| 2013/0244915 | A1* | 9/2013 | DeBlase | C10M 169/04 508/167 |
| 2016/0201004 | A1* | 7/2016 | DeBlase | C10M 101/02 508/364 |
| 2020/0362259 | A1* | 11/2020 | Simms | C10M 135/18 |

OTHER PUBLICATIONS

Mirci, et al. "New Citric Esters with Aromatic Content and a Complex Structure Considered as Tribological Fluids", Apr. 2003, pp. 1-6.
Supplementary Partial European Search Report corresponding to European Application No. 19/752,058, dated Oct. 1, 2021, one page.

* cited by examiner

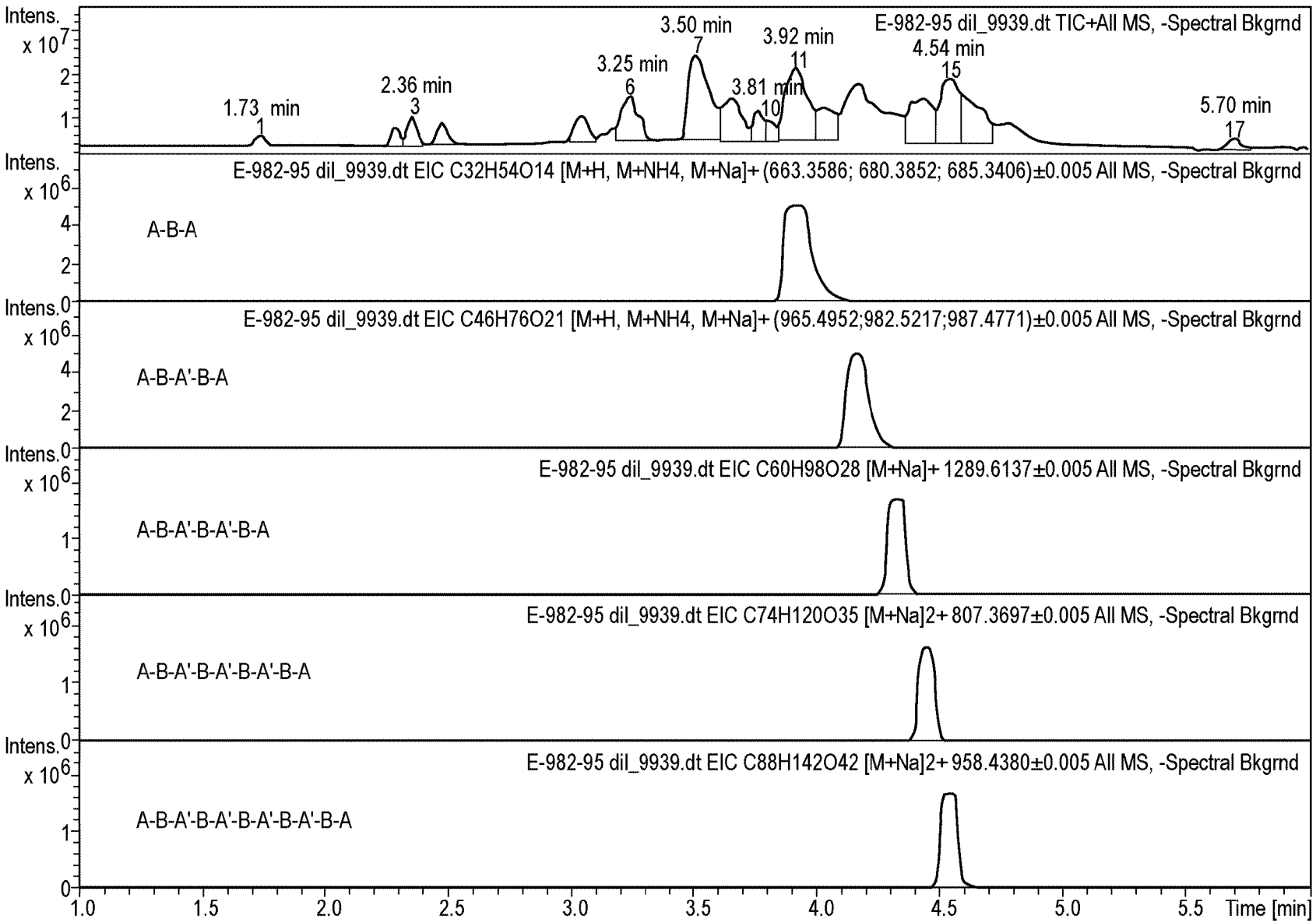
E-982-95 dil_9939.dt TIC+All MS, -Spectral Bkgrnd
1.73 min
2.36 min
3.25 min
3.50 min
3.81 min
3.92 min
4.54 min
5.70 min
E-982-95 dil_9939.dt EIC C32H54O14 [M+H, M+NH4, M+Na]+ (663.3586; 680.3852; 685.3406)±0.005 All MS, -Spectral Bkgrnd
A-B-A
E-982-95 dil_9939.dt EIC C46H76O21 [M+H, M+NH4, M+Na]+ (965.4952;982.5217;987.4771)±0.005 All MS, -Spectral Bkgrnd
A-B-A'-B-A
E-982-95 dil_9939.dt EIC C60H98O28 [M+Na]+ 1289.6137±0.005 All MS, -Spectral Bkgrnd
A-B-A'-B-A'-B-A
E-982-95 dil_9939.dt EIC C74H120O35 [M+Na]2+ 807.3697±0.005 All MS, -Spectral Bkgrnd
A-B-A'-B-A'-B-A'-B-A
E-982-95 dil_9939.dt EIC C88H142O42 [M+Na]2+ 958.4380±0.005 All MS, -Spectral Bkgrnd
A-B-A'-B-A'-B-A'-B-A'-B-A
Intens.
Time [min]

ANTI-WEAR COMPOSITION FOR LUBRICANTS

This application claims priority benefit to U.S. Provisional Application No. 62/629,171, filed Feb. 12, 2018, which is incorporated herein by reference in its entirety.

A variety of additives have been developed to improve the lifetime and effectiveness of lubricants, such as engine oils. These additives include antioxidants, anti-wear agents, deposit control agents, friction modifiers, additives to improve lubricity and load bearing properties, etc. Some additives serve more than one function, for example, zinc dialkyldithiophosphates (ZDDP) have been used as anti-fatigue, anti-wear, antioxidant, extreme pressure and friction modifying agents for lubricating oils for many years. However, ZDDP is subject to several drawbacks due to the presence of zinc and phosphorus.

Zinc dihydrocarbyldithiophosphate is a general term that includes zinc dialkyldithiophosphates, zinc diaryldithiophosphates, zinc alkylaryldithiophosphates and combinations thereof. ZDDP has been used as an anti-wear additive in formulated oils for more than 50 years. However, zinc dihydrocarbyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used in cars to reduce pollution. Due to these drawbacks, attempts continue to be made to develop fully organic additives that can replace at least a portion of ZDDP. While it is important to limit particulate matter and pollution formed during engine use for toxicological and environmental reasons, it is also important to maintain undiminished the anti-wear properties of the lubricating oil.

U.S. Pat. No. 5,338,470 discloses citrate esters, formed by reacting citric acid with 1, 2 or 3 equivalents of an alcohol, as anti-wear and friction modifying additives for fuel and lubricants. The anti-wear and friction reduction properties of mixtures derived from citric acid and oleyl alcohol are demonstrated.

U.S. Pat. No. 7,696,136 discloses lubricant compositions containing esters of hydroxy carboxylic acids, such as citrates and tartrates, which are useful as non-phosphorus-containing, anti-fatigue, anti-wear, extreme pressure additives for fuels and lubricating oils. The esters are used alone or in combination with a zinc dihydrocarbyldithiophosphate or an ashless phosphorus-containing additive, such as tri-lauryl phosphate or triphenylphosphorothionate. The use of short chain esters, such as tri-ethyl citrate, borated tri-ethyl citrate and di-butyl tartrate, is said to allow one to reduce the amount of ZDDP while maintaining good anti-wear properties.

A challenge in developing organic friction modifiers is that while they must be polar enough to absorb on metal surfaces, they must also be soluble enough in the oil so that they are completely solubilized and not significantly self-associated in the lubricant. Agglomerates of self-associated compounds will not form the even film required on the metal surfaces for smooth operation of the engine. On the other hand, the compound must not be so soluble in the oil that it fails to come out of solution to coat the metal surfaces in a timely fashion. Despite the challenges, there remains a need for new organic friction modifiers, anti-wear agents and other fuel additives, preferably liquid additives, which can provide a means for further reducing the amount of metal species, such as zinc, used in truck or automobile engine lubricants.

Meeting this need, the presently disclosed citric acid derivatives, e.g., citrate and citramide compounds, including compounds comprising multiple citric acid moieties, e.g., citrate dimers, trimers and the like, are shown and described herein to have friction reducing activity and excellent anti-wear activity in lubricant compositions, such as those used in internal combustion engines, transmissions and the like.

In one embodiment of the present disclosure, the invention provides a lubricant composition comprising: A) a lubricating oil, and B) 0.2 to 5 wt %, based on the weight of the lubricant composition, of one or more compounds of formula I, II, III, IV, V, and/or VI.

It has been found that compounds of formula I, II, III, IV, V, and/or VI and mixtures of said compounds, e.g., mixtures of citrates which in some embodiments comprise citrate dimers, trimers and higher oligomers, provide excellent anti-wear and friction reduction activity in lubricants, and in at least many embodiments, exhibit a high degree of synergy in combination with zinc dihydrocarbyldithiophosphates. The compounds of the invention are thus valuable tools that can allow one to reduce the amounts of zinc, and phosphates, that are used in the lubricant without sacrificing anti-wear performance, etc.

Many embodiments of the invention relate to compounds of formula I, II and/or III:

I

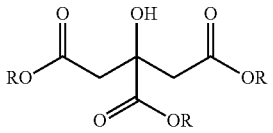

II

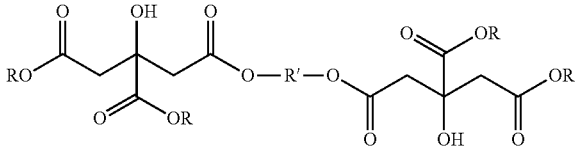

-continued

III

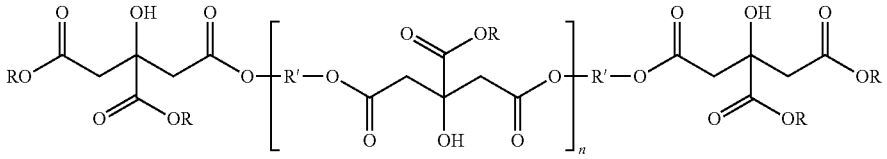

wherein R is an alkyl group that may be interrupted by —O—, carbonyl, carbonyloxy, carbocycle or heterocycle, and/or substituted by OH, carbocycle or heterocycle, R' is an alkylene group that may be interrupted by —O—, carbonyl, carbonyloxy, carbocycle or heterocycle, and/or substituted by OH, carbocycle or heterocycle;

and n is 1 to 20.

Unless otherwise specified, the alkyl or alkylene group may be linear, branched or cyclic; and the carbocycle or heterocycle may be monocycle, bicycle or polycycle and may be further substituted by alkyl.

Some embodiments relate to compounds of formula II or III, or mixtures of compounds II and III; some embodiments relate to mixtures of compounds of formula I, II and/or III; some embodiments relate to particular compounds of formula I, for example, compounds of formula I where R is a carbocycle or heterocycle, alkyl substituted by carbocycle or heterocycle, or alkyl interrupted by —O—, such as a polyether. The present disclosure includes lubricant compositions comprising compounds of the preceding embodiments, and lubricant compositions comprising compounds of the preceding embodiments and ZDDP.

Other embodiments relate to compounds of formula IV, including lubricant compositions comprising compounds of formula IV, and lubricant compositions comprising compounds of formula IV along with compounds of formula I, II, or III, or ZDDP,

IV

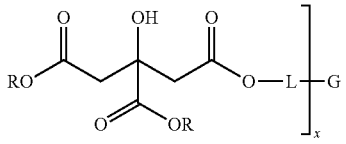

wherein R is as defined above, L is $C_{1-12}$ alkylene, $C_{1-12}$ alkylene interrupted by —O—, carbonyl, carbonyloxy, and G is a nitrogen atom or a group comprising one or more nitrogen atoms, such as a linear or branched primary alkyl amine, or a linear, branched, or cyclic polyamine; for example:

IVa

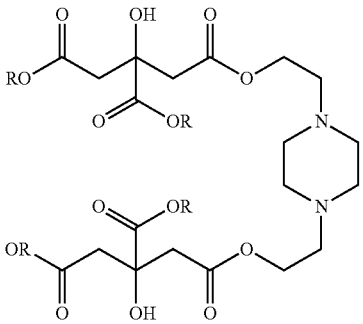

-continued

IVb

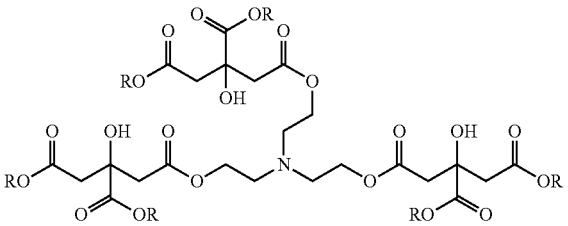

Further embodiments provide compounds of formula V, Va, VI, or VIa:

V

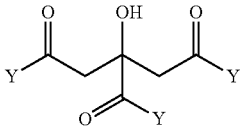

Va

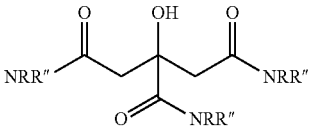

VI

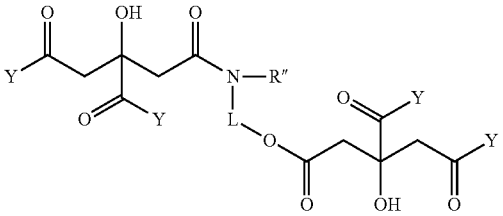

VIa

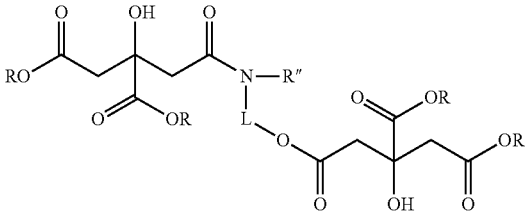

wherein L and R are as defined above, R" is H or R, and Y is OR or NRR" provided that in formula V at least one Y is NRR".

Generally, in compounds of formula V, two or all three Y groups are NRR", e.g., formula Va. Often, in compounds of formula VI, the majority or all Y groups are OR, e.g., formula VIa.

The preceding summary is not intended to restrict in any way the scope of the claimed invention. In addition, it is to be understood that both the foregoing general description and the following detailed description are exemplary and explanatory only and are not restrictive of the invention, as claimed.

BRIEF DESCRIPTION OF THE FIGURES

FIG. 1 shows a Liquid Chromatography Mass Spectrometry (LCMS) analysis of an exemplary product reaction mixture obtained by the reaction of citric acid and butane diol and conversion of residual acids to butyl esters in accordance with the present disclosure.

DETAILED DESCRIPTION

The compounds and compound combinations of the invention exhibit friction reduction activity and anti-wear activity in lubricants. The friction reduction activity is often higher than the activity seen with currently used citrate lubricant additives, and in many embodiments, the anti-wear activity of the compounds of the invention surpasses that of known citric acid derived additives, e.g., citrates, and even ZDDP. In many cases, compounds of the invention show synergy when mixed with ZDDP. The excellent activity of the compounds of the invention allows one to reduce the amount of ZDDP present in automobile and truck lubricants, thereby reducing the zinc and phosphorus content of the lubricants.

Throughout the present application, "a" or "an" means one or more than one unless indicated otherwise.

Citrate compounds useful in lubricant compositions of the present invention include compounds of formula I, II or III:

I

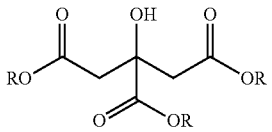

II

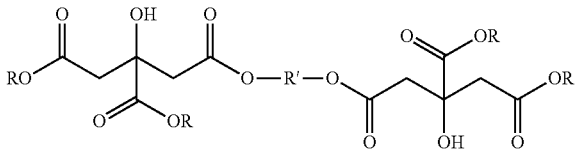

III

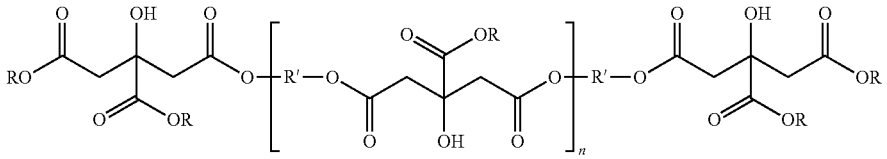

wherein:

n is 1 to 20, e.g., 1 to 10, 1 to 5, or 1 to 3;

R is $C_{1-15}$ alkyl;

$C_{1-18}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl interrupted by one or more —O—, carbonyl, carbonyloxy and/or substituted by OH;

$C_{2-18}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy; and R' is $C_{2-18}$ alkylene;

$C_{2-18}$ alkylene interrupted by one or more —O—, carbonyl or carbonyloxy and/or substituted by OH, a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy.

For example, compounds of formula I, II or III wherein:

R is $C_{1-16}$ alkyl, $C_{1-12}$ alkyl or $C_{1-6}$ alkyl, said alkyl substituted by a carbocycle comprising 5 to 12 carbon atoms or a heterocycle comprising 3 to 8 carbon atoms and one or more heteroatoms selected from O, S and N, wherein the carbocycle or the heterocycle may be substituted by one or more $C_{1-8}$ alkyl or alkyloxy;

$C_{2-16}$ alkyl, $C_{2-12}$ alkyl or $C_{2-6}$ alkyl interrupted by one or more —O—, carbonyl, carbonyloxy and/or substituted by a carbocycle comprising 5 to 12 carbon atoms or a heterocycle comprising 3 to 8 carbon atoms and one or more heteroatoms selected from O, S and N, wherein the carbocycle or heterocycle may be substituted by $C_{1-8}$ alkyl or alkyloxy; or carbocycle comprising 5 to 12 carbon atoms, or a heterocycle comprising 3 to 8 carbon atoms and one or more heteroatoms selected from O, S and N, wherein the carbocycle or heterocycle may be substituted by $C_{1-8}$ alkyl or alkyloxy; and R' is $C_{2-16}$ alkylene, $C_{2-12}$ alkylene or $C_{2-8}$ alkylene, said alkylene interrupted by one or more —O—, carbonyl or carbonyloxy and/or substituted by OH, a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-8}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-8}$ alkyl or alkyloxy.

Alkyl may be linear alkyl or branched alkyl; alkylene may be linear alkylene or branched alkylene. Alkylene refers to a hydrocarbon based chain or group connected to two other groups, also known as an alkyl-diyl. Carbocycle and heterocycle may be aromatic or non-aromatic, monocyclic or polycyclic. Alkyl or alkylene interrupted by —O— may be an ether, for example, R may be as shown in parentheses:

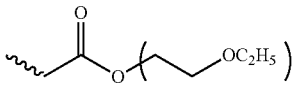

or polyether, for example, R' may be as shown in parentheses:

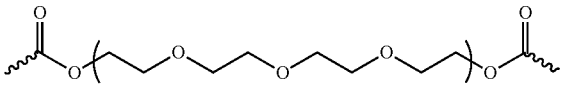

In some exemplary embodiments:

R is ethyl, propyl, butyl, pentyl, hexyl, heptyl, octyl, benzyl, norbornane methyl, adamantyl, tetrahydrofurfuryl, triethylene glycol mono-methyl ether, and isomers thereof, such as, isopropyl isobutyl, sec-butyl, tert-butyl, iso-pentyl, tert-pentyl, 2-ethylhexyl, and the like; and R' is ethane diyl; propane 1,2- or 1,3-diyl; butane 1,4-, 1,2 or 1,3 diyl; pentane 1,5 or 1,4 diyl; hexane 1,6-diyl; 2-ethyl hexane 1,6-diyl; and the like.

Compounds of formula IV can also be used in lubricant compositions of the invention, either on their own or in combination with other citrates or citramides, and with or without synergistic antiwear additives such as ZDDP:

IV

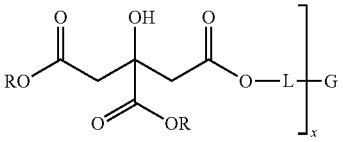

wherein R is as defined above, x is 2, 3, 4, 5 or 6, typically 2 or 3, L is a linking group, such as, $C_{1-12}$ alkylene, $C_{1-12}$ alkylene interrupted by —O—, carbonyl, carbonyloxy, and G is a nitrogen atom or a group comprising one or more nitrogen atoms, such as a linear or branched primary amine or linear, branched or cyclic polyamine. Compounds of formula IV can be prepared in a straightforward manner, e.g.:

IVb

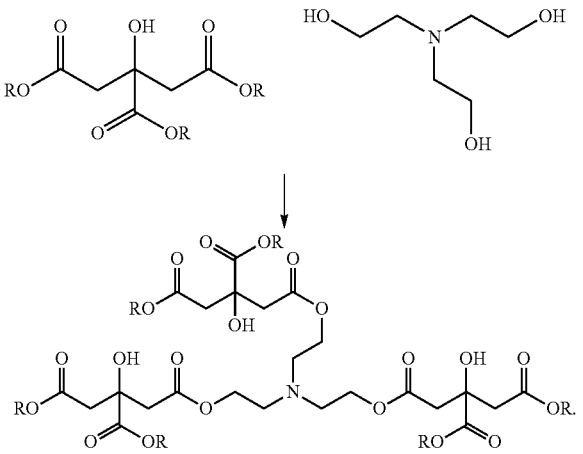

Further embodiments provide compounds of formula V and VI and lubricant compositions comprising them:

V

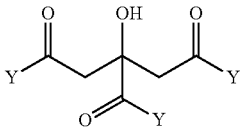

VI

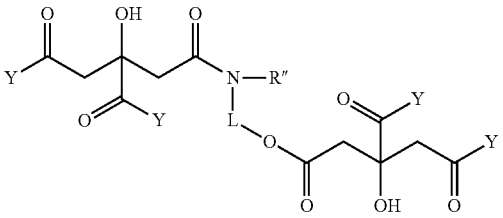

wherein L and R are as defined above, R" is H or R, and Y is OR or NRR" provided that in formula V at least one Y is NRR". Generally, in compounds of formula V, two or all three Y groups are NRR", e.g., formula Va, and often in compounds of formula VI, the majority or all Y groups are OR, e.g., formula VIa:

Va

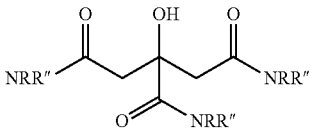

VIa

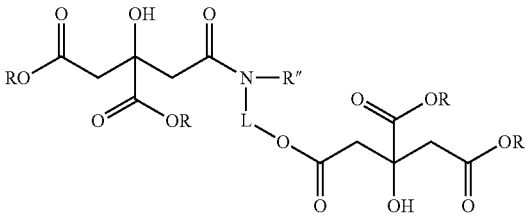

Primary amines such as 2-ethylhexylamine, secondary amines such as N-butyl-N-methyl amine, long chain amines such as oleic amine, and mixtures of amines such as tallow amine, have been used to construct many of the amide groups in the formula above. For example, data obtained from lubricant compositions comprising tris(2-ethylhexyl) citramide, tris(N-butyl-N-methyl) citramide, trioleyl citramide, tritallow citramide, tris(hydrogenated tallow) citramide, tritallow citramide, and trioleyl citramide can be found in the Examples.

A hydroxyalkyl amine can be conveniently used to form the —N-L-O— linking segment found in formula VI and VIa. For example, bis (2-hydroxypropyl)amine can be used in the preparation of compounds of formula VIa like:

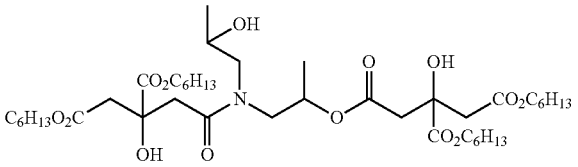

Compositions of the invention comprise, for example:

A) a natural or synthetic lubricating oil, and

B) from about 0.25 to about 5 wt %, e.g., about 0.5 to about 5, about 0.5 to about 3, about 0.5 to about 2, about 0.75 to about 1.5 wt %, based on the weight of the lubricant composition, of one or more compounds of formula II, III, IV, V or VI and optionally compounds of formula I, as described above, e.g., a composition comprising at least one compound of formula II and at least one compound of formula III, or a composition comprising at least one compound of formula I, at least one compound of formula II, and at least one compound of formula III.

A composition comprising:

A) a natural or synthetic lubricating oil, and

B) from about 0.25 to about 5 wt %, e.g., about 0.5 to about 5, about 0.5 to about 3, about 0.5 to about 2, about 0.75 to about 1.5 wt %, based on the weight of the lubricant composition, of one or more compounds of formula I wherein R is a carbocycle or heterocycle, alkyl substituted by carbocycle or heterocycle, or alkyl interrupted by —O—, such as a polyether; for example, the compound of formula I may be tris benzyl, tris norbornane methyl, tris adamantyl, tris tetrahydrofurfuryl, or tris triethylene glycol monomethyl ether esters of citric acid, and the like.

Further embodiments provide lubricant compositions comprising one or more of the citrates or citramides above and ZDDP. Due to the excellent activity of the compounds of the invention, one can use less ZDDP, and thus lower the amount of zinc and phosphorus in a lubricant while maintaining excellent anti-wear and anti-friction properties. In many embodiments, synergistic activity is seen when certain citrates and citramides are blended with ZDDP, i.e., activity of the blend at a load level exceeds the activity of either the citric acid based component, (e.g., citrate or citramide), or the ZDDP at the same load level.

For example, the invention provides a composition comprising;

A) a natural or synthetic lubricating oil, and

B) from about 0.25 to about 5 wt %, e.g., about 0.5 to about 5, about 0.5 to about 3, about 0.5 to about 2, about 0.75 to about 1.5 wt %, based on the weight of the lubricant composition, of one or more compounds of formula I, II, III, IV, V and/or VI and ZDDP in a weight ratio of citric acid based component to ZDDP of 3:1 to 1:3; 2:1 to 1:2; 1.5:1 to 1:1.5; 2:1 to 1:1; 1:1 to 1:2.

Citrates of formula I can be prepared by any known esterification process. Some embodiments provide lubricant compositions comprising compounds of formula I wherein R is a carbocycle or heterocycle, alkyl substituted by carbocycle or heterocycle, or alkyl interrupted by —O—, such as a polyether; for example, tris benzyl, tris norbornane methyl, trisadamantyl, tris tetrahydrofurfuryl, or tris triethylene glycol mono-methyl ether esters of citric acid, and the like. Such compounds can be used with or without other citrates, and with or without synergistic anti-wear additives such as ZDDP.

In one method of preparing compounds of formula II and III, citric acid is reacted with a polyol, such as a diol, often in the presence of an acid catalyst, such as methane sulfonic acid, to obtain a dimer, trimer, various other oligomers, etc., depending on the relative amounts of citric acid and polyol used, followed by standard esterification of the remaining carboxylic acid groups, e.g., reaction with a monohydric alcohol in the presence of an acid, i.e., a two-step method. In an alternate method, citric acid is reacted with an alcohol, such as butanol, and a diol, such as 1,6-hexanediol, together, in the presence of a catalyst, e.g., an acid catalyst, at the same time in the same vessel, i.e., a one-step method.

Often, depending on the process for the preparation of compounds of formula III, and even when attempting to prepare predominately compounds of formula II, a mixture of compounds of formula III differing in the value for n will be present in varying amounts. For example, when preparing predominately a trimer, i.e., a compound of formula III wherein n=1, it is common for dimers, monomeric compounds, tetramers and pentamers to also be present. In some instances, mixtures such as these are desirable, as mixtures often can exhibit a higher degree of solubility than a single component.

In one example, FIG. 1 shows a Liquid Chromatography Mass Spectrometry (LCMS) analysis of an exemplary product reaction mixture obtained by the reaction of citric acid and butane diol and conversion of residual acids to butyl esters in accordance with the present disclosure. The top Total Ion Chromatogram (TIC) is that of the whole product mixture with all oligomers. The individual peaks provided in the rows below represent separate HPLC isolated oligomers. The main product oligomers shown include a coupled product or dimer-citrate oligomer (terminal citrate ester represented as (A), and the linker diol as (B), giving A-B-A oligomer), a trimer-citrate oligomer A-B-A'-B-A (again citrate terminal esters (A) and added internal ester (A'), joined by the diol linker (B)), a tetramer-citrate oligomer designated as A-B-A'-B-A'-B-A, followed by a pentamer-citrate oligomer A-B-A'-B-A'-B-A'-B-A, and a hexamer-citrate oligomer A-B-A'-B-A'-B-A'-B-A'-B-A.

Many embodiments of the present disclosure make use of the above one step or two step method to generate mixtures of compounds comprising varying amounts of compounds of formula II and formula III having different values for n. Often, these mixtures will also contain compounds of formula I. By varying conditions, one can increase the amount of a desired component, and, if desired, it is possible to separate the mixtures using standard techniques.

Synergistic activity is seen when certain compounds of the invention are blended with ZDDP, i.e., activity of the blend at a load level exceeds the activity of either the citric acid derivative or the ZDDP at the same load level. For example, as shown in the Examples, lubricant compositions comprising 1 wt % of a 1:1 mixture of ZDDP and select citrates or citrate mixtures comprising a compound of formula II, provide better anti-wear protection than either 1 wt % ZDDP or 1 wt % of the same citrate compound(s).

Lubricant compositions containing a reference 5W-30 oil without any other antiwear additives, were blended with 1 wt % of citrates of the invention or various industry standards, e.g., 1 wt % ZDDP, triethyl citrate or tributyl citrate, and tested for anti-wear activity using standard 4-ball anti-wear tests ASTM D4172, and a modified ASTM D4172 where 0.615 wt % cumene hydroperoxide (chp) was added to the lubricant to simulate oxidative aging. Another series of tests was run using lubricant compositions containing 0.5 wt % ZDDP and 0.5 wt % inventive citrate additives. Full results can be found in the Examples.

Several of the inventive compounds exhibited improved performance over the commercial alkyl citrate additives triethyl citrate or tri-n-butyl citrate. For example, bis-trihexylcitrate dioxalate, bis-trioctylcitrate dioxalate, and four higher citrate oligomers, hexane-1,6-diyl bis-dihexyl citrate, ethane-1,2-diyl bisdihexyl citrate, propane-1,2-diyl bisdihexyl citrate, and butane-1,4-diyl bisdihexyl citrate all provided significantly better anti-wear performance than the commercial citrate standards. Among the bis dialkyl citrate diol linked oligomers, the bis-dihexyl citrates appeared to have some advantage over shorter chain esters. 1,2-ethanediol, 1,2-propane-diol, and 1,4-butane-diol linkers showed some advantage over the 1,6-hexane-diol linked oligomers.

In one comparison, oligomers of bis-dihexyl citrate formed in one step from citric acid and a mixture of 1,6-hexane-diol and n-hexanol provided better anti-wear performance than a similar mixture of compounds formed in two steps, first reacting citric acid with 1,6-hexane diol followed by reaction with n-hexanol. In another comparison, 2-ethyl hexyl citrate dioxalate underperformed the hexyl counterparts bis-trihexyl citrate dioxalate and bis-trioctylcitrate dioxalate. It appears possible that gains in solubility due to the branching of the 2-ethyl hexyl derivative may be offset by the same branching interfering with the compound organizing on the surface.

Significant synergy was observed when ZDDP was blended with either hexane-1,6-diyl bis-dihexyl citrate, ethane-1,2-diyl bisdihexyl citrate, or propane-1,2-diyl bisdihexyl citrate, either in the presence or absence of chp, e.g.:

| Sample | Wear, mm, no chp, 0.5 wt % sample/ 0.5 wt % ZDDP | Wear, mm, chp, 0.5 wt % sample/ 0.5 wt % ZDDP |
|---|---|---|
| STD, no additive | 0.598 | 0.740 |
| ZDDP | 0.441 | 0.476 |
| Hexane-1,6-diyl, bisdihexyl citrate 1 -step | 0.335 | 0.386 |
| Ethane-1,2-diyl bisdihexyl citrate | 0.308 | 0.379 |
| Propane-1,2-diyl bisdihexyl citrate | 0.325 | 0.349 |

Commercial lubricant formulations typically contain a variety of other additives, for example, dispersants, detergents, corrosion/rust inhibitors, antioxidants, anti-wear agents, anti-foamants, friction modifiers, seal swell agents, demulsifiers, V.I. improvers, pour point depressants, and the like. A sampling of these additives can be found in, for example, U.S. Pat. Nos. 5,498,809 and 7,696,136, the relevant portions of each disclosure are incorporated herein by reference, although the practitioner is well aware that this comprises only a partial list of available lubricant additives. It is also well known that one additive may be capable of providing or improving more than one property, e.g., an anti-wear agent may also function as an anti-fatigue and/or an extreme pressure additive.

The lubricant compositions of the invention will often contain any number of these additives. Thus, final lubricant compositions of the invention will generally contain a combination of additives along with the inventive citrates, in a combined concentration ranging from about 0.5 to about 30 weight percent, e.g., from about 0.5 to about 10 weight percent based on the total weight of the oil composition. For example, the combined additives may be present from about 1 to about 5 weight percent. Oil concentrates of the additives can contain from about 30 to about 75 weight percent additives.

Given the ubiquitous presence of additives in a lubricant formulation, the amount of lubricating oil present in the inventive composition is not specified above, but in most embodiments, except additive concentrates, the lubricating oil is a majority component, i.e., present in more than 50 wt % based on the weight of the composition, for example, 60 wt % or more, 70 wt % or more, 80 wt % or more, 90 wt % or more, or 95 wt % or more.

The natural or synthetic lubricating oil of the invention can be any suitable oil of lubricating viscosity. For example, a lubricating oil base stock is any natural or synthetic lubricating oil base stock fraction having a kinematic viscosity at 100° C. of about 2 to about 200 cSt, about 3 to about 150 cSt, and often about 3 to about 100 cSt. The lubricating oil base stock can be derived from natural lubricating oils, synthetic lubricating oils, or mixtures thereof. Suitable lubricating oil base stocks include, for example, petroleum oils, mineral oils, and oils derived from coal or shale petroleum based oils, animal oils, such as lard oil, vegetable oils (e.g., canola oils, castor oils, sunflower oils) and synthetic oils.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from monocarboxylic acids or diacids and polyols and polyol ethers. Other esters useful as synthetic oils include those made from copolymers of alphaolefins and dicarboxylic acids which are esterified with short or medium chain length alcohols.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alphaolefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a V.I. of at least 130, preferably at least 135 or higher and, following dewaxing, a pour point of about −20° C. or lower.

The friction modifying mixture of metal based friction modifier and hydroxy carboxylic ester or amide of the invention can be added to the lubricating oil directly as a combination or as individual components. The mixture can be added by itself or along with other common additives. A concentrate containing the mixture may also be prepared and added to the lubricating oil. It is also possible to add the friction modifying mixture to a preformulated lubricating oil which already contains all or most of the other formulation components.

The lubricating oil compositions of the invention can be used in a variety of applications, for example, crankcase lubricating oils for spark-ignited and compression-ignited internal combustion engines, gas engine lubricants, turbine lubricants, automatic transmission fluids, gear lubricants, compressor lubricants, metal-working lubricants, hydraulic fluids, and other lubricating oil and grease compositions.

Further non-limiting disclosure is provided in the Examples that follow.

EXAMPLES

Compounds, typically mixtures of compounds of the following formula, wherein x is a number of from 1 to 20 and R and R' are as described above, are prepared according to general procedures A or B.

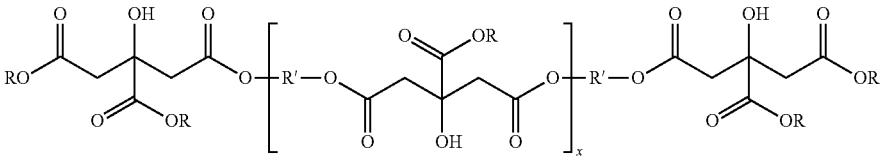

General Procedure 1

A) To a mixture of citric acid, diol and toluene is added a catalytic amount of methanesulfonic or other acid, the flask is equipped with a Dean-Stark trap and condenser, flushed with $N_2$, then heated to reflux with stirring. The reaction can be followed by any standard means. When judged complete, the reaction is cooled to ambient temperature, washed with saturated sodium bicarbonate and brine, the organic layer is dried over anhydrous sodium sulfate, filtered, and typically heated to 60° C. under vacuum, to yield the final product, typically as a mixture comprising dimers, trimers and higher oligomers of different chain lengths.

B) The product from A is combined with an alcohol, e.g., a mono-hydroxy alkyl, toluene, and a catalytic amount of methanesulfonic or other acid, the flask is equipped with a Dean-Stark trap and condenser, flushed with $N_2$, then heated to reflux with stirring. When judged complete, the reaction is cooled to ambient temperature, washed with saturated sodium bicarbonate and brine, the organic layer is dried over anhydrous sodium sulfate, filtered, and typically heated to 60° C. under vacuum, to yield the final product.

General Procedure 2

To a mixture of citric acid, diol, mono-hydroxy alkyl and toluene is added a catalytic amount of methanesulfonic or other acid, the flask is equipped with a Dean-Stark trap and condenser, flushed with $N_2$, then heated to reflux with stirring. The reaction can be followed by any standard means. When judged complete, the reaction is then cooled to ambient temperature, washed with saturated sodium bicarbonate and brine, the organic layer is dried over anhydrous sodium sulfate, filtered, and typically heated to 60° C. under vacuum, to yield the final product, typically as a mixture comprising dimers, trimers and higher oligomers of different chain lengths.

Citrate products of the invention were prepared using the following pairs of diols and mono-hydroxy alkyl using the process of General Procedure 1 or General Procedure 2. Some of the pairs were used to prepared citrate products following each of the General Procedures. For example, products were prepared using the mixture of Ex 10, i.e., 1, 6-hexane diol and hexanol according to General Procedure 1, and a separate product mixture was prepared from 1, 6-hexane diol and hexanol according to General Procedure 2.

| EX | Diol | mono-Hydroxyl Alkyl |
|---|---|---|
| 1 | 1,2-Ethane diol | Hexanol |
| 2 | 1,2-Propane diol | Hexanol |
| 3 | 1,4-Butane diol | Ethanol |
| 4 | 1,4-Butane diol | Hexanol |
| 5 | 1,6-Hexane diol | Butanol |
| 6 | 1,2-Proane diol | Butanol |
| 7 | 1,4-Butane diol | Butanol |
| 8 | 1,6-Hexane diol | Hexanol |

-continued

| EX | Diol | mono-Hydroxyl Alkyl |
|---|---|---|
| 9 | 1,4-Butane diol | 2-Ethylhexanol |
| 10 | 1,6-Hexane diol | iso-Pentanol |

Example 11—Tris(tetrahydrofurfuryl) citrate

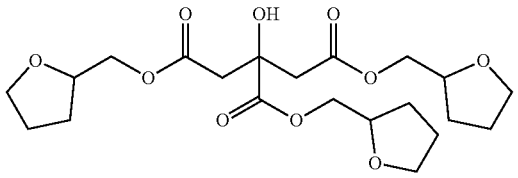

Citric acid (8.0 g, 42 mmol) and tetrahydrofurfuryl alcohol (14.9 g, 146 mmol) were weighed into a flask, toluene (80 ml) and methanesulfonic acid (0.10 ml, 1.5 mmol) were added, the flask was equipped with a Dean-Stark trap and condenser, the flask was flushed with $N_2$, then heated to reflux with stirring for 6.5 h. The reaction mixture was cooled to ambient temperature, washed with saturated sodium bicarbonate, and brine. The organic layer was dried over anhydrous sodium sulfate, filtered, and heated to 60° C. for 1.5 h under vacuum (0.5 torr) to provide the final product as a yellow oil (9.5 g).

Example 12—Mixed Ethyl-tetrahydrofurfuryl citrate

Triethyl citrate (12.01 g, 43.47 mmol) and tetrahydrofurfuryl alcohol (15.03 g, 147.2 mmol) were weighed into a 3 neck flask equipped with a condenser with distillate collection flask, vacuum attachment, and $N_2$ inlet. The system was flushed with $N_2$, heated to 65° C. and sodium methoxide (0.50 ml of a 25 wt % MeOH solution, 2.2 mmol) was added. The temperature was increased to 85° C. and the reaction mixture was stirred for 12 h under vacuum (200 torr). Additional sodium methoxide (0.30 ml of a 25 wt % MeOH solution, 1.3 mmol) was added and the reaction was continued for an additional 11 h, after which the reaction mixture was cooled to ambient temperature, diluted with toluene (30 ml), and washed with saturated sodium bicarbonate and brine. The organic layer was dried over anhydrous sodium sulfate and filtered leaving a solution that was placed under vacuum to remove volatile components to provide the product as an amber oil (12 g).

Example 13—Tris(1-adamantyl) citrate

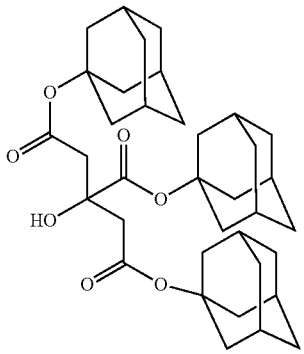

Citric acid (2.00 g, 10.4 mmol), 1-adamantanol (4.94 g, 32.4 mmol), and p-toluenesulfonic acid monohydrate (0.197 g, 1.04 mmol) and toluene (70 ml) were added to a flask that was equipped with a Dean Stark trap and condenser, then flushed with $N_2$, and heated to reflux with stirring for 76 h, after which the reaction mixture was cooled to ambient temperature, washed with 2 M aqueous NaOH, water, and brine. The organic layer was dried over anhydrous sodium sulfate and filtered to provide a solution which was placed under vacuum to remove volatile components and provide a yellow solid crude product. Unreacted 1-adamantanol was removed from the crude product by sublimation under vacuum (50 mtorr) at temperatures increasing from 120° C. to 165° C. for 5 h to provide the final product as a yellow solid (1.59 g).

Example 14—Tris(2-adamantyl) citrate

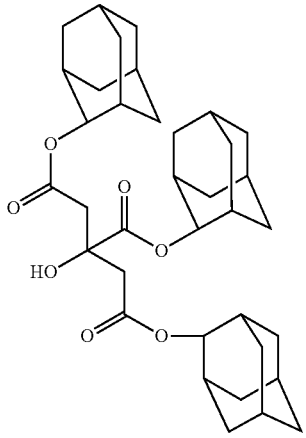

Citric acid (2.00 g, 10.4 mmol), 2-adamantanol (4.90 g, 32.2 mmol), toluene (60 ml), and methanesulfonic acid (0.09 ml, 1 mmol) were added to a flask that was equipped with a Dean-Stark trap and condenser, then flushed with $N_2$, then heated to reflux with stirring for 70 h. The reaction mixture was cooled to ambient temperature, washed with saturated sodium bicarbonate and brine, the organic layer was dried over anhydrous sodium sulfate, filtered, and then heated to 60° C. for 2 h under vacuum (0.5 torr) to provide a white solid crude product. Unreacted 2-adamantanol was removed from the crude product by sublimation under vacuum (50 mtorr) at 145° C. for 6 h to provide the final product as a white solid (4.08 g).

Example 15—Tris(2-norbornanemethyl)citrate

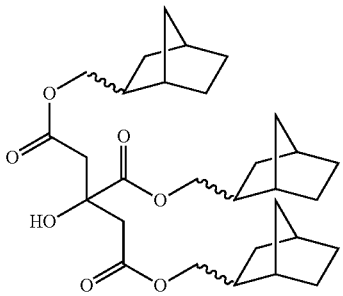

Citric acid (4.0 g, 21 mmol) and 2-norbornanemethanol (mixture of endo and exo, 9.7 g, 77 ml, 0.8 mmol), toluene (60 ml) and methanesulfonic acid (0.10 ml, 1.5 mmol) were added to a flask that was equipped with a Dean-Stark trap and condenser, then flushed with $N_2$, and heated to reflux with stirring for 70 h, after which the reaction mixture was cooled to ambient temperature, washed with saturated sodium bicarbonate and brine. The organic layer was dried over anhydrous sodium sulfate, filtered, and then heated to 60° C. for 2 h under vacuum (0.5 torr) to yield the final product as an amber oil.

Example 16—Tris(Triethylene glycol monomethyl ether) citrate

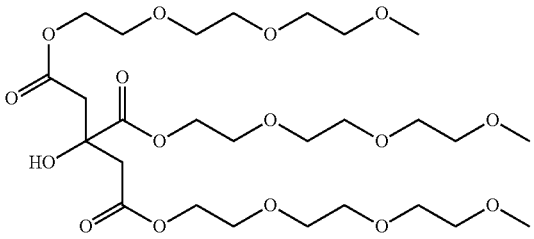

Citric acid (8.0 g, 42 mmol) and triethylene glycol monomethyl ether (23.0 g. 140 mmol) toluene (60 ml) and methanesulfonic acid (0.10 ml, 1.5 mmol) were added to a flask that was equipped with a Dean-Stark trap and condenser, then flushed with $N_2$, and heated to reflux with stirring for 17 h, after which the reaction mixture was cooled to ambient temperature and washed with saturated sodium bicarbonate and brine. The resulting sodium bicarbonate solutions were then washed with ethyl acetate. The ethyl acetate washings were dried over anhydrous sodium sulfate, filtered, and then heated to 60° C. for 2 h under vacuum (0.5 torr) to yield the final product as a clear colorless liquid (11 g).

Example 17—Tribenzyl citrate

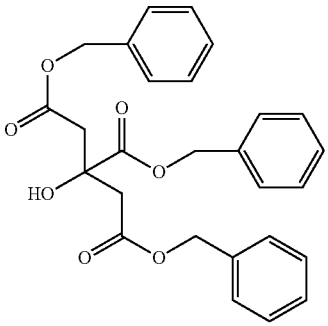

Citric acid (4.00 g, 20.8 mmol) and benzyl alcohol (6.78 g, 62.7 mmol), toluene (60 ml) and methanesulfonic acid (0.10 ml, 1.5 mmol) were added to a flask that was equipped with a Dean-Stark trap and condenser. The flask was flushed with $N_2$, heated to reflux with stirring for 26 h, after which the reaction mixture was cooled to ambient temperature, diluted with toluene (50 ml), and washed with saturated sodium bicarbonate, water, and brine. The organic layer was dried over anhydrous sodium sulfate, filtered, then heated to 60° C. for 2 h under vacuum (0.5 torr) to provide the crude product as a yellow liquid. The crude product was purified by silica column chromatography using hexanes/ethyl acetate (5:1 to 3:1) mobile phase to provide the final product as a clear colorless liquid (5.5 g).

Example 18—1,4-bis(ethyl-2-diethylcitrate)piperazine

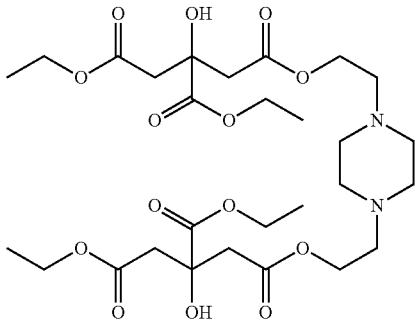

1,4-Bis(2-hydroxyethyl)piperazine (2.03 g, 11.7 mmol) and triethyl citrate (26.02 g, 94.19 mmol) were added to a flask equipped with a thermocouple, $N_2$ supply, and rubber stopper. The mixture was stirred and $N_2$ was bubbled through the liquid reaction mixture for 20 min while the mixture was heated to 70° C. Sodium methoxide (0.525 ml of a 25 wt. % MeOH solution, 2.30 mmol) was added dropwise causing a color change from colorless to dark yellow. The rubber stopper was removed and distillation head was attached along with a condenser, vacuum adapter and receiving flask. Vacuum was slowly applied (approx. 100 torr) while heating at 85 and stirring for 5 h, after which the reaction mixture was cooled to ambient temperature, diluted with ethyl acetate, and washed with $H_2O$ and brine. The organic layer was dried over anhydrous sodium sulfate, filtered, and concentrated to a volume of 50 ml. The crude product was purified by silica column chromatography using ethyl acetate/methanol (neat ethyl acetate to 3:1 mixture) mobile phase to provide the final product as an amber oil (3.9 g).

Example 19—1,4-bis(ethyl-2-dibutylcitrate)piperazine

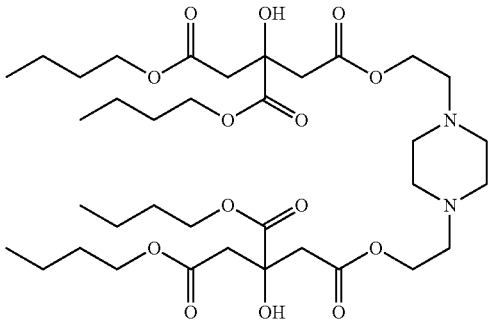

1,4-Bis(2-hydroxyethyl)piperazine (1.92 g, 11.0 mmol) and tributyl citrate (31.53 g, 87.48 mmol) were added to a 3 neck flask equipped with a condenser, distillate collection flask, vacuum attachment, and $N_2$ inlet. The system was flushed with $N_2$ and sodium methoxide (0.510 ml of a 25 wt. % MeOH solution, 2.23 mmol) was added. The temperature was increased to 85° C., the reaction mixture was stirred for 7 h under vacuum (approx. 0.1 torr), additional sodium methoxide (0.125 ml of a 25 wt. % MeOH solution, 0.547 mmol) was added and the reaction was continued for an additional 5 h. The reaction mixture was then cooled to ambient temperature, diluted with ethyl acetate, and washed with $H_2O$ and brine. The organic layer was dried over anhydrous sodium sulfate, filtered and concentrated to a volume of 70 ml. The crude product was purified by silica column chromatography using ethyl acetate mobile phase to provide the final product as an amber oil (1.7 g).

Example 20—Tris(ethyl-2-dibutylcitrate)amine

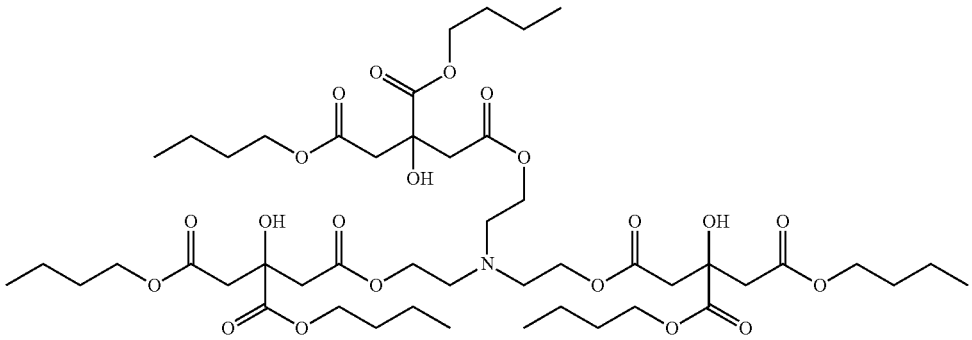

Triethylamine (1.64 g, 11.0 mmol) and tributyl citrate (31.97 g, 88.71 mmol) were added to a 3 neck flask equipped with a thermocouple, $N_2$ supply, and rubber stopper. The mixture was stirred and heated to 70° C. while $N_2$ was bubbled through the liquid reaction mixture for 1 h. Sodium methoxide (0.500 ml of a 25 wt % MeOH solution. 2.19 mmol) was then added dropwise, the rubber stopper was removed, a distillation head, condenser, vacuum adapter and receiving flask were attached and vacuum was slowly applied (approx. 0.3 torr) while heating at 80° C. and stirring for 3 h. The reaction mixture was then cooled to ambient temperature, diluted with ethyl acetate, washed twice with a 15/2 $H_2O$/brine mixture, followed by washing with brine. The organic layer was dried over anhydrous sodium sulfate, filtered and concentrated to a volume of 80 ml. The crude product was purified by silica column chromatography using hexanes/ethyl acetate (1:1) mobile phase to provide the final product as a yellow oil (0.65 g).

Example 21—Performance Tests

Lubricant compositions comprising a reference 5W-30 oil without any other anti-wear additives, and containing 1 wt % of additives of the invention were tested for anti-wear activity using standard 4-ball anti-wear tests ASTM D4172, and modified ASTM D4172 procedure where 0.615% cumene hydroperoxide (chp) was added to the lubricant to simulate oxidative aging. The results were compared to those obtained using 1 wt % ZDDP, triethyl citrate or tributyl citrate. Another series of tests used lubricant compositions containing 0.5 wt % ZDDP and 0.5 wt % citrate additives. The results are shown in the tables below:

| Sample | Wear, mm, no chp, 1 wt % sample | Wear, mm, no chp, 0.5 wt % sample/ 0.5 wt % ZDDP | Wear, mm, chp 1 wt % sample | Wear, mm, chp, 0.5 wt % sample/ 0.5 wt % ZDDP |
|---|---|---|---|---|
| STD | 0.598 | | 0.740 | |
| ZDDP | 0.441 | 0.441 | 0.476 | 0.476 |
| NL 810 (Triethyl citrate) | 0.500 | | 0.601 | |
| NL 812 (Tributyl citrate) | 0.468 | 0.428 | 0.578 | 0.500 |
| Tri-hexyl citrate | 0.460 | 0.375 | 0.560 | 0.445 |
| Bis-trihexyl citrate dioxalate | 0.381 | | 0.503 | |
| Bis-trioctyl citrate dioxalate | 0.385 | | 0.506 | |
| Bis-triethyl citrate dioxalate | 0.458 | | 0.542 | |
| Bis-tri-2-ethylhexyl citrate dioxalate | 0.427 | | 0.535 | |
| Butane-1,4-diyl bisdiethyl citrate | 0.452 | | 0.537 | |
| Hexane-1,6-diyl bisdihexyl citrate (2-step) | 0.456 | | 0.560 | |
| Hexane-1,6-diyl bisdihexyl citrate (1-step) | 0.398 | 0.335 | 0.502 | 0.386 |
| Ethane-1,2-diyl bisdihexyl citrate | 0.415 | 0.308 | 0.487 | 0.379 |
| Propane-1,2-diyl bisdihexyl citrate | 0.425 | 0.325 | 0.500 | 0.349 |
| Butane-1,2-diyl bisdihexyl citrate | 0.426 | | 0.517 | |

| Sample | Wear, mm, no chp 1 wt % sample | Wear, mm, chp, 1 wt % sample | Wear, mm, chp, 0.5 wt % sample/ 0.5 wt % ZDDP |
|---|---|---|---|
| STD | 0.573 | 0.540 | 0.540 |
| STD + 0.5% ZDDP | 0.446 | 0.604 | 0.604 |
| ZDDP | 0.446 | 0.491 | 0.491 |
| Tributyl citrate | 0.468 | 0.578 | 0.502 |
| mixed Ethvl-tetrahydrofurfuryl-citrate | 0.430 | 0.560 | 0.475 |
| Tris(tetrahydrofurfuryl) citrate | 0.413 | 0.531 | 0.465 |
| Tris(1-adamantyl) citrate | 0.455 | 0.544 | 0.556 |
| Tris(2-adamantyl) citrate | 0.466 | 0.581 | 0.537 |
| Tris(2-norbornanemethyl) citrate | 0.478 | 0.583 | 0.526 |
| Tris(triethvleneqlvcol mono-methvl ether) citrate | 0.421 | 0.557 | 0.559 |
| Tribenzvl citrate. | 0.557 | 0.518 | 0.513 |
| 1,4-Bis(ethyl-2-diethyl citrate) piperazine | 0.472 | — | — |
| 1,4-Bis(ethyl-2-dibutyl citrate) piperazine | 0.473 | 0.557 | 0.482 |
| Tris(ethyl-2-dibutyl citrate) amine | 0.500 | 0.572 | 0.461 |

The following series of citric acid derivatives, amides and ester, were tested for anti-wear activity as above.

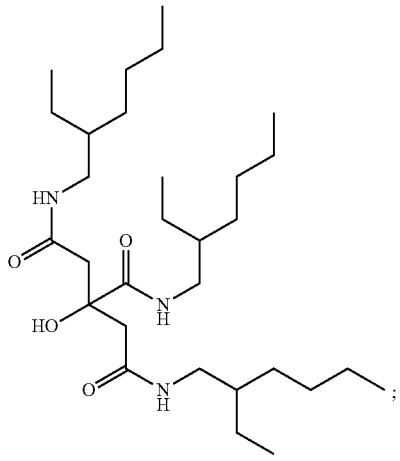

Tris(2-ethylhexyl) citramide

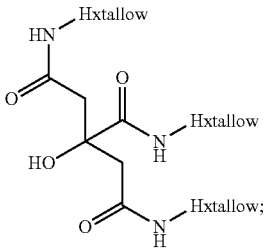

Tris(hydrogenated tallow) citramide

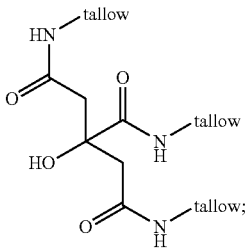

Tritallow citramide

-continued

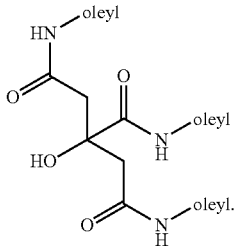

Trioleyl citramide

Di-hexylhydroxy ethyl citrate, may contain minor amounts of Dihydroxethyl hexyl citrate,

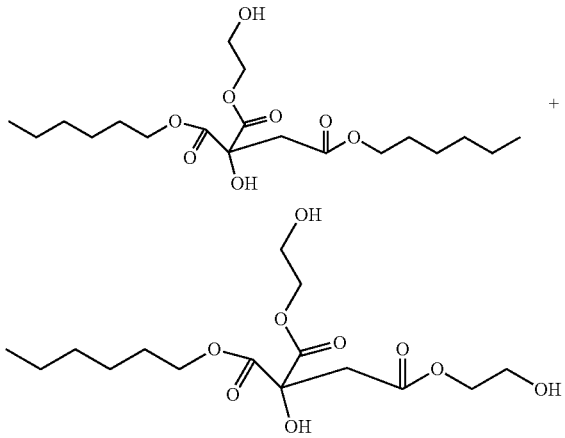

| Sample | Wear, mm, no chp, 1 wt % sample | Wear, mm, no chp, 0.5 wt % sample/ 0.5 wt % ZDDP | Wear, mm, chp, 1 wt % sample | Wear, mm, chp, 0.5 wt % sample/ 0.5 wt % ZDDP |
|---|---|---|---|---|
| STD | 0.584 | | 0.684 | |
| ZDDP | 0.488 | 0.488 | 0.529 | 0.529 |
| Mixed 2-ethylhexylamide-ethylester- citrate | 0.466 | 0.373 | 0.680 | 0.459 |
| Tris(2-ethylhexyl) citramide | 0.447 | 0.415 | 0.630 | 0.652 |
| Tris(hydrogenated tallow) citramide | 0.418 | 0.407 | 0.637 | 0.501 |
| Tritallow citramide | 0.427 | 0.436 | 0.841 | 0.637 |
| Trioleyl citramide | 0.502 | 0.478 | 0.710 | 0.534 |
| Di-hexylhydroxy ethyl citrate | 0.527 | 0.374 | 0.593 | 0.415 |

Tri (N-butyl-N-methyl) citramide was tested separately at 1 wt % in a different commercial 5W-30 motor oil that was fully formulated except that it contained no anti-wear additives.

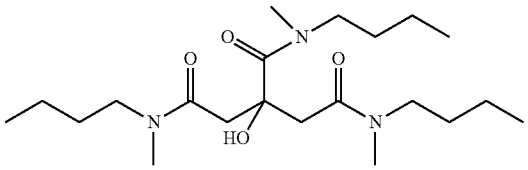

| Sample | Wear, mm, no chp, 1 wt % sample | Wear, mm, chp, 1 wt % sample |
|---|---|---|
| 5W-30 w/o Anti-Wear STD | 0.736 | 0.798 |
| Tris(N-butyl-N-methyl) citramide | 0.328 | 0.576 |

Although particular embodiments of the present invention have been illustrated and described, this description is not meant to be construed in a limiting sense. Various changes and modifications may be made without departing from the principle and scope of the present invention, which is defined by the appended claims.

What is claimed is:

1. A lubricant composition comprising:

A) a lubricating oil, and

B) 0.2 to 5 wt %, based on the weight of the lubricant composition, of ii) a compound of formula II

II

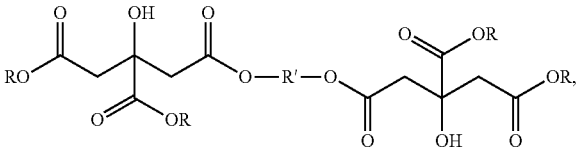

iii) a compound of formula III

III

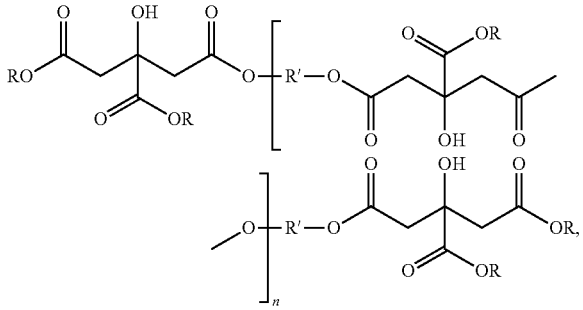

or iv) a mixture of compounds of formula II and formula Ill, wherein:

n is from 1 to 20,

R is $C_{1-18}$ alkyl;

$C_{1-18}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl interrupted by one or more —O—, carbonyl, carbonyloxy and/or substituted by OH;

$C_{2-18}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy; and R' is $C_{2-18}$ alkylene;

$C_{2-18}$ alkylene interrupted by one or more —O—, carbonyl or carbonyloxy and/or substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy, wherein each R and each R' may be the same or different from any other R or R'.

2. The lubricant composition according to claim 1 comprising more than one compound of formula III, which differ by having different values of n.

3. The lubricant composition according to claim 1 further comprising i) a compound of formula I:

I

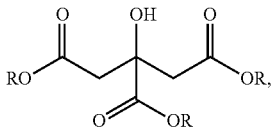

wherein R is as described for formula II and III, and the wt % of all compounds of formula I, II and III combined is from 0.2 wt % to 5.0 wt % based on the weight of the lubricant composition.

4. The lubricant composition according to claim 1 wherein:

n is from 1 to 10, 1 to 5, or 1 to 3;

R is $C_{1-16}$ alkyl, $C_{1-12}$ alkyl or $C_{1-6}$ alkyl, said alkyl substituted by a carbocycle comprising 5 to 12 carbon atoms or a heterocycle comprising 3 to 8 carbon atoms and one or more heteroatoms selected from O, S and N, wherein the carbocycle or the heterocycle may be substituted by one or more $C_{1-8}$ alkyl or alkyloxy;

$C_{2-16}$ alkyl, $C_{2-12}$ alkyl or $C_{2-6}$ alkyl interrupted by one or more —O—, carbonyl, carbonyloxy and/or substituted by a carbocycle comprising 5 to 12 carbon atoms or a heterocycle comprising 3 to 8 carbon atoms and one or more heteroatoms selected from O, S and N, wherein the carbocycle or heterocycle may be substituted by $C_{1-8}$ alkyl or alkyloxy; or a carbocycle comprising 5 to 12 carbon atoms, or a heterocycle comprising 3 to 8 carbon atoms and one or more heteroatoms selected from O, S and N, wherein the carbocycle or heterocycle may be substituted by $C_{1-8}$ alkyl or alkyloxy, and R' is $C_{2-16}$ alkylene, $C_{2-12}$ alkylene or $C_{2-8}$ alkylene, said alkylene interrupted by one or more —O—, carbonyl or carbonyloxy and/or substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-8}$ alkyl or alkyloxy; or said alkylene, interrupted alkylene or substituted alkylene interrupted by a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-8}$ alkyl or alkyloxy.

5. The lubricant composition according to claim 4 further comprising i) a compound of formula I:

I

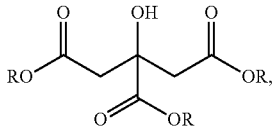

wherein R is as described for formula II and III and the wt % of all compounds of formula I, II and III combined is from 0.2 wt % to 5.0 wt %, based on the weight of the lubricant composition.

6. The lubricant composition according to claim 5, which comprises at least one compound of formula I, at least one compound of formula II, and at least one compound of formula III, wherein n is from 1 to 5; R is $C_{1-12}$ alkyl or $C_{2-12}$ alkyl interrupted by one or more —O—, and R' is $C_{2-12}$ alkylene, or said alkylene interrupted by one or more —O—.

7. The lubricant composition according to claim 1 further comprising ZDDP.

8. The lubricant composition according to claim 7 wherein the citrates and ZDDP are present in a weight ratio of citrate to ZDDP of 3:1 to 1:3.

9. The lubricant composition according to claim 1 wherein the lubricating oil is present at about 90 wt % or more.

10. The lubricant composition according to claim 1 further comprising one or more additional lubricant additive selected from the group consisting of dispersants, detergents, corrosion/rust inhibitors, antioxidants, anti-wear agents, anti-foamants, friction modifiers, seal swell agents, demulsifiers, V.I. improvers and pour point depressants.

11. A lubricant composition comprising:

A) a lubricating oil, and

B) 0.2 to 5 wt %, based on the weight of the lubricant composition, of i) a compound of formula I:

I

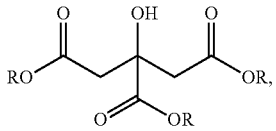

wherein R is a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

$C_{1-6}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy; or $C_{6-18}$ alkyl interrupted by one or more —O—, carbonyl, or carbonyloxy and substituted by OH, carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy.

12. The lubricant composition according to claim 11 further comprising ZDDP.

13. The lubricant composition according to claim 12 wherein the citrates and ZDDP are present in a weight ratio of citrate to ZDDP of 3:1 to 1:3.

14. The lubricant composition according to claim 11 wherein the lubricating oil is present at about 90 wt % or more.

15. The lubricant composition according to claim 11 further comprising one or more additional lubricant additive selected from the group consisting of dispersants, detergents, corrosion/rust inhibitors, antioxidants, anti-wear agents, anti-foamants, friction modifiers, seal swell agents, demulsifiers, V.I. improvers and pour point depressants.

16. A lubricant composition comprising:

A) a lubricating oil, and

B) 0.2 to 5 wt %, based on the weight of the lubricant composition, of a compound of formula IV:

IV

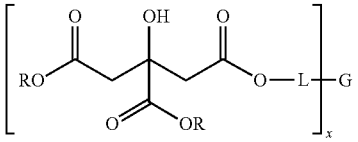

wherein:

R is $C_{1-18}$ alkyl;

$C_{1-18}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl interrupted by one or more —O—, carbonyl, carbonyloxy and/or substituted by OH;

$C_{2-18}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy;

x is 2, 3, 4, 5, or 6,

L is $C_{1-12}$ alkylene or $C_{2-12}$ alkylene interrupted by —O—, carbonyl, carbonyloxy, and G is a nitrogen atom or a group comprising one or more nitrogen atoms.

17. The lubricant composition according to claim 16 wherein G is a nitrogen atom, or a linear or branched primary amine, or a linear, branched, or cyclic polyamine.

18. The lubricant composition according to claim 16 further comprising ZDDP.

19. The lubricant composition according to claim 18 wherein the citrates and ZDDP are present in a weight ratio of citrate to ZDDP of 3:1 to 1:3.

20. The lubricant composition according to claim 16 wherein the lubricating oil is present at about 90 wt % or more.

21. The lubricant composition according to claim 16 further comprising one or more additional lubricant additive selected from the group consisting of dispersants, detergents, corrosion/rust inhibitors, antioxidants, anti-wear agents, and anti-foamants.

22. A lubricant composition comprising:

A) a lubricating oil, and

B) 0.2 to 5 wt %, based on the weight of the lubricant composition, of a compound of formula V or VI:

V

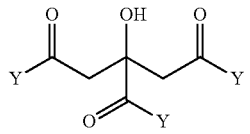

VI

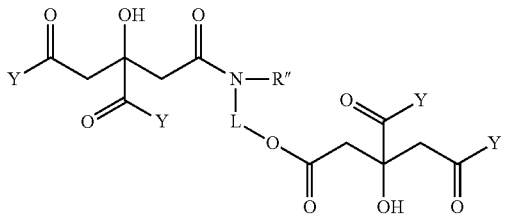

wherein Y is OR or NRR" provided that in formula V at least one Y is NRR"

L is $C_{1-12}$ alkylene or $C_{2-12}$ alkylene interrupted by —O—, carbonyl, carbonyloxy R is $C_{1-18}$ alkyl;

$C_{1-18}$ alkyl substituted by a carbocycle comprising 5 to 12 carbon atoms or a heterocycle comprising 3 to 11 carbon atoms and one or more heteroatoms selected from O, S and N, wherein the carbocycle or the heterocycle may be substituted by one or more $C_{1-12}$ alkyl or alkyloxy;

$C_{2-18}$ alkyl interrupted by one or more —O—, carbonyl, carbonyloxy and/or substituted by OH;

$C_{2-18}$ alkyl interrupted by one or more —O—, carbonyl or carbonyloxy and substituted by a carbocycle comprising 5 to 12 carbon atoms or a heterocycle comprising 3 to 11 carbon atoms and one or more heteroatoms selected from O, S and N, wherein the carbocycle or heterocycle may be substituted by $C_{1-12}$ alkyl or alkyloxy; or a carbocycle comprising 5 to 12 carbon atoms, or a heterocycle comprising 3 to 11 carbon atoms and one or more heteroatoms selected from O, S and N, wherein the carbocycle or heterocycle may be substituted by $C_{1-12}$ alkyl or alkyloxy; and R" is H or R, wherein each R and each R" may be the same or different from any other R or R".

23. The lubricant composition according to claim 22 comprising as B) 0.2 to 5 wt %, based on the weight of the lubricant composition, of a compound of formula Va or VIa:

Va

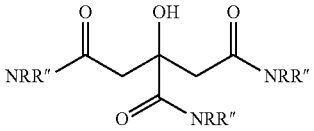

-continued

VIa

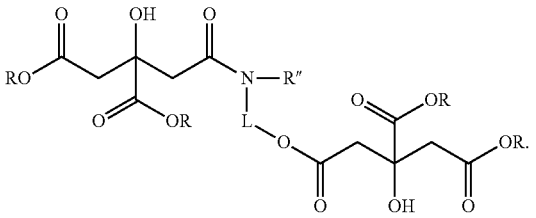

24. The lubricant composition according to claim 22 further comprising ZDDP.

25. The lubricant composition according to claim 24 wherein the citrates and ZDDP are present in a weight ratio of citrate to ZDDP of 3:1 to 1:3.

26. The lubricant composition according to claim 22 wherein the lubricating oil is present at about 90 wt % or more.

27. The lubricant composition according to claim 22 further comprising one or more additional lubricant additive selected from the group consisting of dispersants, detergents, corrosion/rust inhibitors, antioxidants, anti-wear agents, anti-foamants, friction modifiers, seal swell agents, demulsifiers, V.I. improvers and pour point depressants, friction modifiers, seal swell agents, demulsifiers, V.I. improvers and pour point depressants.

* * * * *